US011230410B2

(12) United States Patent
Brunner

(10) Patent No.: US 11,230,410 B2
(45) Date of Patent: Jan. 25, 2022

(54) CONTAINER ASSEMBLIES

(71) Applicant: KETER PLASTIC LTD., Herzliya (IL)

(72) Inventor: Yaron Brunner, Kibbutz Gvat (IL)

(73) Assignee: Keter Plastic Ltd., Herzliya (IL)

( * ) Notice: Subject to any disclaimer, the term of this patent is extended or adjusted under 35 U.S.C. 154(b) by 213 days.

(21) Appl. No.: 15/555,711

(22) PCT Filed: Mar. 6, 2016

(86) PCT No.: PCT/IL2016/050250
§ 371 (c)(1),
(2) Date: Sep. 5, 2017

(87) PCT Pub. No.: WO2016/142935
PCT Pub. Date: Sep. 15, 2016

(65) Prior Publication Data

US 2018/0044059 A1 Feb. 15, 2018

Related U.S. Application Data

(60) Provisional application No. 62/129,069, filed on Mar. 6, 2015.

(51) Int. Cl.
*B65D 21/02* (2006.01)

(52) U.S. Cl.
CPC ..... *B65D 21/0224* (2013.01); *B65D 21/0228* (2013.01)

(58) Field of Classification Search
CPC ..... B65D 21/0224; B65D 21/0228; B65D 21/062; B25H 3/021; B25H 3/026
USPC ..... 206/506; 220/831
See application file for complete search history.

(56) References Cited

U.S. PATENT DOCUMENTS

| | | | |
|---|---|---|---|
| 5,022,546 | A | 6/1991 | Bock |
| D348,152 | S | 6/1994 | Roeper et al. |
| 5,437,369 | A | 8/1995 | Spitere |
| 5,699,925 | A | 12/1997 | Petruzzi |
| D415,894 | S | 11/1999 | Courville |
| 6,082,539 | A | 7/2000 | Lee |
| D437,484 | S | 2/2001 | Tiramani et al. |
| D439,407 | S | 3/2001 | Parker |

(Continued)

FOREIGN PATENT DOCUMENTS

| | | | |
|---|---|---|---|
| CN | 201923584 | U | 8/2011 |
| CN | 201990010 | U | 9/2011 |

(Continued)

*Primary Examiner* — James N Smalley
*Assistant Examiner* — Madison L Poos
(74) *Attorney, Agent, or Firm* — Vorys, Sater, Seymour & Pease LLP; William Klima

(57) ABSTRACT

Provided is a container assembly including a container for storage and transport of goods including at least one side wall and a bottom wall defining together an interior space and a cover for closing the opening, having a top surface. The cover may include at least one latch member movable between at least a first position and a second position. The container may also include a retaining member on the at least one side wall and positioned parallel to the latch member such that the latch member is configured for engaging with a retaining member of another container to connect the container to the at least one other container.

11 Claims, 11 Drawing Sheets

(56) References Cited

U.S. PATENT DOCUMENTS

| | | | | |
|---|---|---|---|---|
| D449,738 | S | 10/2001 | Snider et al. | |
| 6,371,320 | B2 | 4/2002 | Sagol | |
| D462,519 | S | 9/2002 | Gaydos et al. | |
| D467,424 | S | 12/2002 | Hardigg et al. | |
| D467,426 | S | 12/2002 | Hardigg et al. | |
| D493,284 | S | 7/2004 | Lee | |
| 6,761,366 | B1 | 7/2004 | Klemmensen et al. | |
| 6,874,634 | B2 | 4/2005 | Riley | |
| 6,889,838 | B2 * | 5/2005 | Meier | B25H 3/021 206/508 |
| D520,237 | S | 5/2006 | Cheng | |
| D527,181 | S | 8/2006 | Henning et al. | |
| D564,216 | S | 3/2008 | Thai | |
| D572,479 | S | 7/2008 | Buck et al. | |
| 7,503,569 | B2 | 3/2009 | Duvigneau | |
| D600,912 | S | 9/2009 | Brunner | |
| D609,911 | S | 2/2010 | Twig | |
| D613,560 | S | 4/2010 | Robichaud et al. | |
| D629,607 | S | 12/2010 | Sabbag et al. | |
| D630,435 | S | 1/2011 | Brunner | |
| D630,851 | S | 1/2011 | Landau et al. | |
| 7,905,353 | B2 | 3/2011 | Baker et al. | |
| D636,994 | S | 5/2011 | Okuda et al. | |
| D643,217 | S | 8/2011 | Pedersen | |
| D647,300 | S | 10/2011 | Shitrit et al. | |
| D649,350 | S | 11/2011 | Shitrit | |
| D649,783 | S | 12/2011 | Brunner | |
| D653,832 | S | 2/2012 | Mlkomirski et al. | |
| 8,206,058 | B2 * | 6/2012 | Vrondran | E02D 29/14 220/831 |
| D663,952 | S | 7/2012 | Crevling, Jr. et al. | |
| D668,048 | S | 10/2012 | Vilkomirski et al. | |
| D674,605 | S | 1/2013 | Vilkomirski et al. | |
| 8,505,729 | B2 | 8/2013 | Sosnovsky et al. | |
| D693,121 | S | 11/2013 | Bensman et al. | |
| D694,522 | S | 12/2013 | Horovitz | |
| 8,602,217 | B2 | 12/2013 | Sosnovsky et al. | |
| D700,777 | S | 3/2014 | Shitrit et al. | |
| D701,696 | S | 4/2014 | Shitrit et al. | |
| D701,697 | S | 4/2014 | Sabbag et al. | |
| D702,044 | S | 4/2014 | Shitrit et al. | |
| D703,436 | S | 4/2014 | Sabbag et al. | |
| D703,437 | S | 4/2014 | Bar-Erez | |
| D709,287 | S | 7/2014 | Shitrit | |
| D709,697 | S | 7/2014 | Brunner | |
| 8,789,699 | B2 | 7/2014 | Patstone et al. | |
| D710,098 | S | 8/2014 | Horowitz | |
| D710,100 | S | 8/2014 | Brunner | |
| D711,105 | S | 8/2014 | Brunner | |
| D713,639 | S | 9/2014 | Whitlock et al. | |
| 8,851,282 | B2 | 10/2014 | Brunner | |
| 8,875,888 | B2 | 11/2014 | Koenig et al. | |
| D719,352 | S | 12/2014 | Shitrit | |
| D753,394 | S | 4/2016 | Brunner | |
| D753,395 | S | 4/2016 | Brunner | |
| D753,396 | S | 4/2016 | Brunner | |
| D753,397 | S | 4/2016 | Brunner | |
| 9,393,684 | B2 | 7/2016 | Christopher et al. | |
| D804,819 | S | 12/2017 | Faibish et al. | |
| D844,325 | S | 4/2019 | Nelson | |
| D857,386 | S | 8/2019 | Shpitzer | |
| D876,833 | S | 3/2020 | Brunner et al. | |
| 2001/0030403 | A1 | 10/2001 | Johnson et al. | |
| 2004/0134818 | A1 | 7/2004 | Cunningham et al. | |
| 2007/0273114 | A1 | 11/2007 | Katz | |
| 2009/0145790 | A1 | 6/2009 | Panosian et al. | |
| 2009/0236255 | A1 | 9/2009 | Piacenza et al. | |
| 2011/0049824 | A1 | 3/2011 | Bar-Erez et al. | |
| 2011/0139666 | A1 | 6/2011 | Sosnovsky et al. | |
| 2011/0181008 | A1 | 7/2011 | Bensman et al. | |
| 2012/0152944 | A1 | 6/2012 | Vilkomirski et al. | |
| 2012/0312812 | A1 | 12/2012 | Sosnovsky et al. | |
| 2014/0102928 | A1 | 4/2014 | Sabbag et al. | |
| 2014/0197059 | A1 | 7/2014 | Evans et al. | |
| 2014/0375181 | A1 | 12/2014 | Bar-Erez et al. | |
| 2015/0376917 | A1 | 12/2015 | Brunner | |
| 2017/0129097 | A1 | 5/2017 | Engvall et al. | |

FOREIGN PATENT DOCUMENTS

| | | | |
|---|---|---|---|
| CN | 204161752 | U | 2/2015 |
| DE | 10 2007 032 382 | A1 | 1/2008 |
| DE | 20 2012 1 02 760 | U1 | 1/2013 |
| JP | 6-255652 | A | 9/1994 |
| WO | 2017/098513 | A1 | 6/2017 |

* cited by examiner

CONTAINER ASSEMBLIES

TECHNOLOGICAL FIELD

The disclosed subject matter is directed towards stackable and interlockable container assemblies.

BACKGROUND ART

References considered to be relevant as background to the presently disclosed subject matter are listed below:

U.S. Pat. No. 8,505,729

U.S. Pat. No. 6,371,320

U.S. Pat. No. 6,874,634

Acknowledgement of the above references herein is not to be inferred as meaning that these are in any way relevant to the patentability of the presently disclosed subject matter.

BACKGROUND

Container assemblies configured for stacking are known in the art. Furthermore, container assemblies that are stackable and interlockable are known.

For example, U.S. Pat. No. 8,505,729 discloses a container constructed and arranged to be connected to at least one other container. The container has a container portion, a cover, and a latch member movable between a first position and a second position. A retaining member on the container portion is engageable with the latch member. In the first position, the latch member engages the retaining member to inhibit movement of the latch member away from the first position. In the second position, the latch member is engageable with a container portion of the other container to connect the containers.

U.S. Pat. No. 6,371,320 discloses a portable workshop container assembly adapted to store tools and other articles a worker requires to perform various tasks at a workplace. The assembly includes three major components in stacked relation. Also provided is a latching mechanism having a latch which is pivoted by a toggle member to the upper end of the bucket and cooperates with a first catch element mounted at the bottom of the tool box and a second catch element mounted on the rim of the tray. When the tool box rests on the rim, the first and second catch elements are then adjacent each other. In one mode of operation, the latch simultaneously engages the first and second latch elements to interlock all three components to form a unitary assembly that can be wheeled to the work place.

U.S. Pat. No. 6,371,320 discloses a tray system composed of a vertical stack of trays especially adapted to contain, and protect surgical instruments being carried from a sterilizer to an operating site. The trays may have various heights and be arranged in any order in the stack. Each tray includes a plurality of latches, each latch having an arm swingably mounted to the tray and terminated by a projection spaced a selected distance above the tray rim or top when the latch is swung to its latching position. Each tray also includes a corresponding plurality of latching surfaces located under the latches on that tray. The distance between the seating surfaces and latching surfaces of each tray corresponds substantially to the distance of that tray. This enables the latch arms of each tray to be latched to the latching surfaces of an overlying tray in the stack or to a cover so as to form a closed compact transportable package. Different latch embodiments for securing the trays together are also disclosed.

GENERAL DESCRIPTION

The presently disclosed subject matter is directed to a container constructed and arranged to be connected to at least one other container.

The term multi-container assembly as used herein denotes any set of containers configured for articulation to one another, either as a stationary unit or locomotive. Said assembly can be used as a tool cart, workshop, traveling luggage, etc.

The term container as used herein denotes any type of container, or work unit, which can be used as a tool caddy, organizer, traveler bag, cosmetics bag, storage containers, locomoting containers, etc. the term container includes also units used in conjunction with a tool caddy, such as a work bench, etc.

The present disclosure is generally in the field of multi-container assemblies. More specifically the disclosure is directed to a locking system for detachably attaching containers and container assemblies to one another.

In accordance with one aspect of the disclosed subject matter there is provided a container assembly comprising at least one container. The container comprises at least one side wall and a bottom wall defining together an interior space and a cover for closing the opening, having a top surface. The cover comprises at least one latch member movable between at least a first position and a second position and the container comprises a retaining member on the at least one side wall and positioned parallel to the latch member. The latch member is configured for engaging with a retaining member of another container to connect the container to the at least one other container. The latch member can be configured to pivot in a clockwise and a counterclockwise manner The at least one latch member can be pivoted upwards to engage the container of the other container assembly and the at least one latch member can be pivoted downwards to a resting position, where it is flush with the surface of the cover, e.g., its side wall. In accordance with an embodiment the at least one latch member can constitute a handle for the container assembly. The latch\handle can be a U shaped handle pivotably attached to the cover.

In accordance with another aspect of the disclosed subject matter there is provided a container for storage and transport of goods. The container comprises at least one side wall and a bottom wall defining together an interior space. The container further comprises at least one latch member movable between at least a first position and a second position and a retaining member positioned parallel to the latch member. The latch member is configured for engaging with a retaining member of another container to connect the container to the at least one other container. The at least one latch member can be positioned between a position in which the latch member engages the retaining member of the other container assembly and a resting position. In accordance with an embodiment the at least one latch member can constitute a handle for the container assembly.

In accordance with the disclosed subject matter the retaining member is an outwardly protruding hook like member, e.g. a saddle configured and shaped to hold and\or catch and prevent movement of the latch when locked thereon.

In accordance with another aspect of the disclosed subject matter there is provided a container assembly comprising a container and a hinged lid member configured to cover the container. Wherein the hinge area further comprises at least one arresting member such that the lid has a closed and an open configurations wherein the arresting member is disengaged and intermediate positions configured between the open and closed configurations wherein the arresting member is engaged.

When an element is referred to as being "on", "engaged to", "connected to" or "coupled to" another element, it may be directly on, engaged, connected or coupled to the other element, or intervening elements may be present.

As used herein, the term "and/or" includes any and all combinations of one or more of the associated listed items.

Spatially relative terms, such as "inner," "outer," "beneath", "below", "lower", "above", "upper", "top", "bottom" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the container in the figures is turned over, elements described as "below" or "beneath" other elements or features would then be oriented "above" the other elements or features. Thus, the example term "below" can encompass both an orientation of above and below. The container can be otherwise oriented (e.g. rotated 90 degrees or at other orientations) and the spatially relative descriptors used herein interpreted accordingly.

The disclosed subject matter is further directed to a container assembly system comprising at least one first container and at least one second container, detachably attachable to one another by a locking mechanism, the locking mechanism interacts between the at least one first container and at least one second container wherein the at least one first container is configured at a top portion thereof with a pivotable latch member, and the at least one second container is configured at a corresponding bottom portion thereof with an retaining portion, wherein said latch member is pivotable between a locked position at which it engages said retaining portion, and an unlocked position at which it is pivotally displaced into disengagement from said retaining portion.

In accordance with another aspect it is directed to a container assembly comprising a container for storage and transport of goods comprising at least one side wall and a bottom wall defining together an interior space and a cover for closing the opening, having a top surface, wherein the cover comprises at least one latch member movable between at least a first position and a second position and wherein the container comprises a retaining member on the at least one side wall and positioned parallel to the latch member such that the latch member is configured for engaging with a retaining member of another container to connect the container to the at least one other container.

In accordance with yet an aspect it is directed to a container comprising at least one side wall comprising thereon at least one latch member movable between at least a first position and a second position and a retaining member positioned parallel to the latch member, wherein the latch member is configured between a resting position and a position for engaging with a retaining member of another container to connect the container to the at least one other container and wherein the at least one latch member constitutes a handle for the container assembly.

In accordance with yet another aspect there is disclosed a container assembly comprising a container and a hinged lid member configured to cover the container, wherein the hinge area further comprises at least one arresting member and a friction member such that the lid has a closed and an open configurations wherein the arresting member and the friction element are disengaged and intermediate positions configured between the open and closed configurations wherein the friction element engages the arresting member.

Any one or more of the following features, designs and configurations, can be implemented in a container assembly and/or system, according to the present disclosure, individually or in various combinations thereof:

- The at least one latch member can constitute a handle for the container assembly.
- The cover is pivotally connected to a rear side of the container portion.
- Further comprising a carrying handle located on the container portion or the cover portion.
- The latch member is pivotably connected through at least one hinge.
- The interior space of the container is divided into a plurality of compartments.
- The latch member and the engaging member are constructed and arranged to be spaced apart such that they are positioned to be vertically aligned with respect to one another.
- The latch is a pivotable locking member;
- The pivotable locking member can be a carrying handle of a respective first container;
- Each of the at least one first container and the at least one second container can be configured with at least a pair of locking mechanisms, according to a particular example the locking mechanisms can be disposed at least at opposite sides of the respective containers;
- The pivotable locking member, at its locked position, extends in near proximity to a side wall of the first container, and at its unlocked position it can be spaces from said side wall or extend in the near proximity to the side wall;
- A the pivotable locking member can be configured with an agronomic handle portion;
- The locking member can be configured for snap arresting at least at its locked position;
- A container of the assembly can be a foldable work bench;
- A first, bottom most container of the container assembly can be configured with a locomoting arrangement. The locomoting arrangement can be fixed to the bottom most container, or detachably attachable thereto.
- According to one example the locomoting arrangement can be at least a pair of wheels disposed at a rear, bottom portion of the bottom most container;
- The bottom most container can be configured with one or more caster wheels;
- The container assembly can be configured with a one or more handles associated with any one or more of the containers;
- At least some of the containers of a container assembly can be configured as a modular container fitted with a pivotable locking member an arresting portion, rendering each such modular container suitable for serving as either a first container or a second container, i.e. suitable for articulation wither above or below a respective other container.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

Figure 1A:
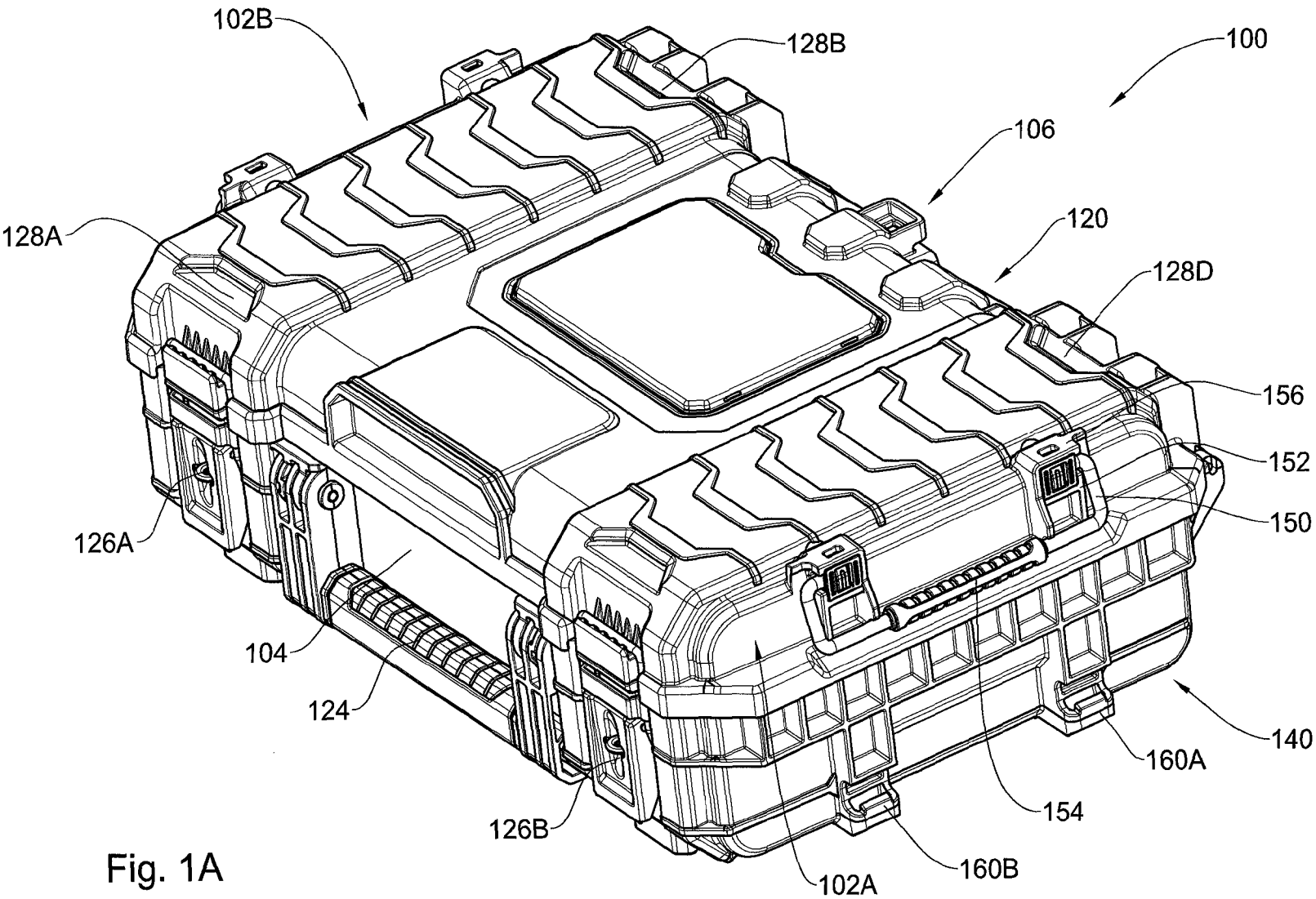
FIGS. 1A and 1B are a perspective top view and a front view, respectively, of the container assembly in accordance with one example of the disclosed subject matter.
Figure 1B:
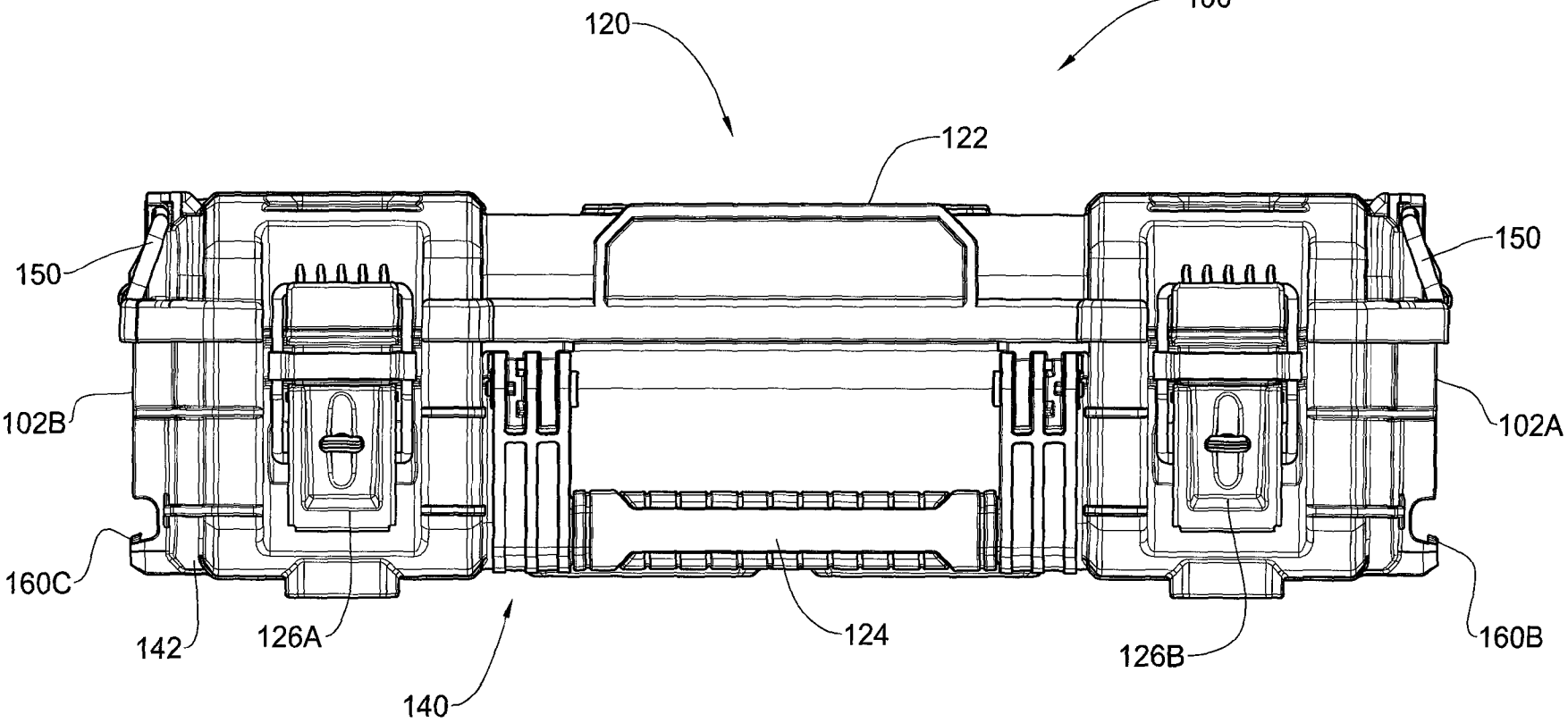

The presently disclosed subject matter is directed to container assemblies adapted for stacking and interlocking with like container assemblies. Referring first to the example of FIGS. 1A to 2B, there is provided a container assembly generally referenced 100. The container assembly 100 comprises a container designated 140 for storage and transport of goods. The container comprises two side walls 102A and 102B, a front wall 104, a rear wall 106 and a bottom wall 108, together defining an interior space (not shown). The container assembly 100 further comprises a cover 120 for closing container 140 at its opening. In the illustrated example, the cover is hingedly attached at the rear wall of the container. It will be appreciated that while in the illustrated example a hinge element is provided, the cover in accordance with the disclosed subject matter can be connected, e.g. through an integral hinge system (e.g. living hinge) or the cover can be a detachably attachable element, etc. The container assembly also comprises a carrying handle 124 at its front wall 104 and two locking latching assemblies 126A and 126B, configured for locking the cover to the container body 140.

The cover 120 further comprises two latch members 150, each extending at its sides and movable between at least a first position I and a second position II. The container comprises two respective retaining members 160A, 160B, 160C, 160D at the lower portion 142 of each of the side walls 102A and 102B. The retaining members are a hook like element integrally formed on and outwardly protruding from respective side wall. It will be appreciated that while in the illustrated example there are provided two retaining members on each side wall, there can be provided one such member which can be of the width sufficient to engage the latch member as will be discussed herein after. An example of a single retaining member is provided with reference to FIG. 4 and will be discussed with reference thereto. Each latch member is positioned parallel to the respective two retaining members (as best seen e.g. in FIG. 1A). The latch member 150 in accordance with this example is pivotable at least between a first resting position seen in FIG. 1A and a fully extending second position seen e.g. on the top container in FIGS. 2A and 2B. In this second position or in fact in any of the intermediate positions, the latch member(s) 150 can constitute side handles for the container assembly. The latch members are a generally U shaped member pivotably connected at its free ends to the cover 120. Thus while the carrying handle 124 facilitates carrying the container assembly vertically such that its rear wall can be for example substantially parallel to the ground, the latch members 150 facilitate carrying the assembly horizontally, using the latch member 150 as two side handles.

Figure 2A:
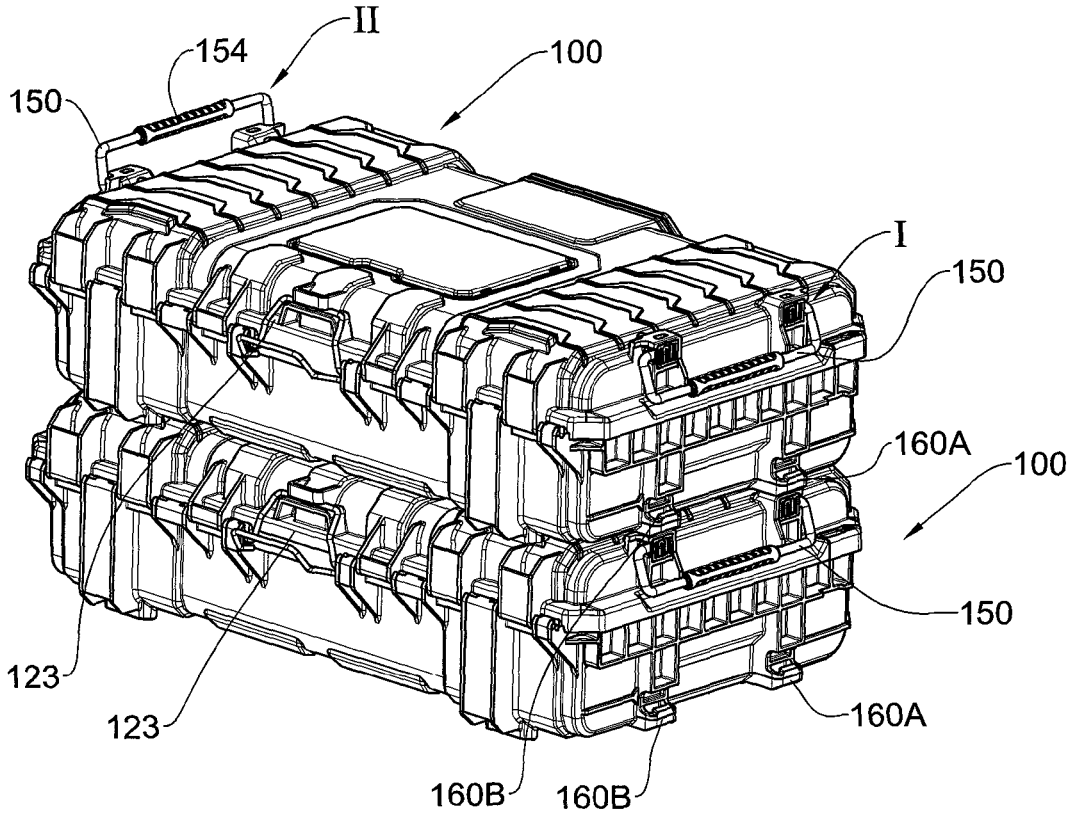
FIGS. 2A to 2B are a perspective top view and a perspective side view, respectively, of two container assemblies of FIG. 1A, stacked one over the other, in accordance with one example of the disclosed subject matter.
Figure 2B:
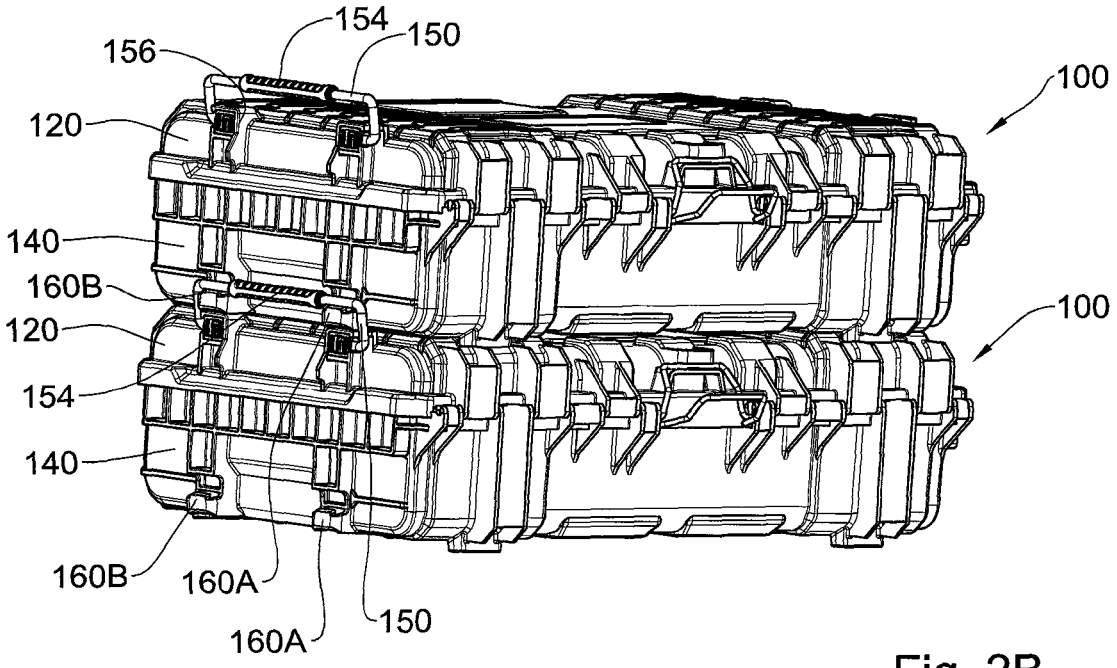
Figure 3:
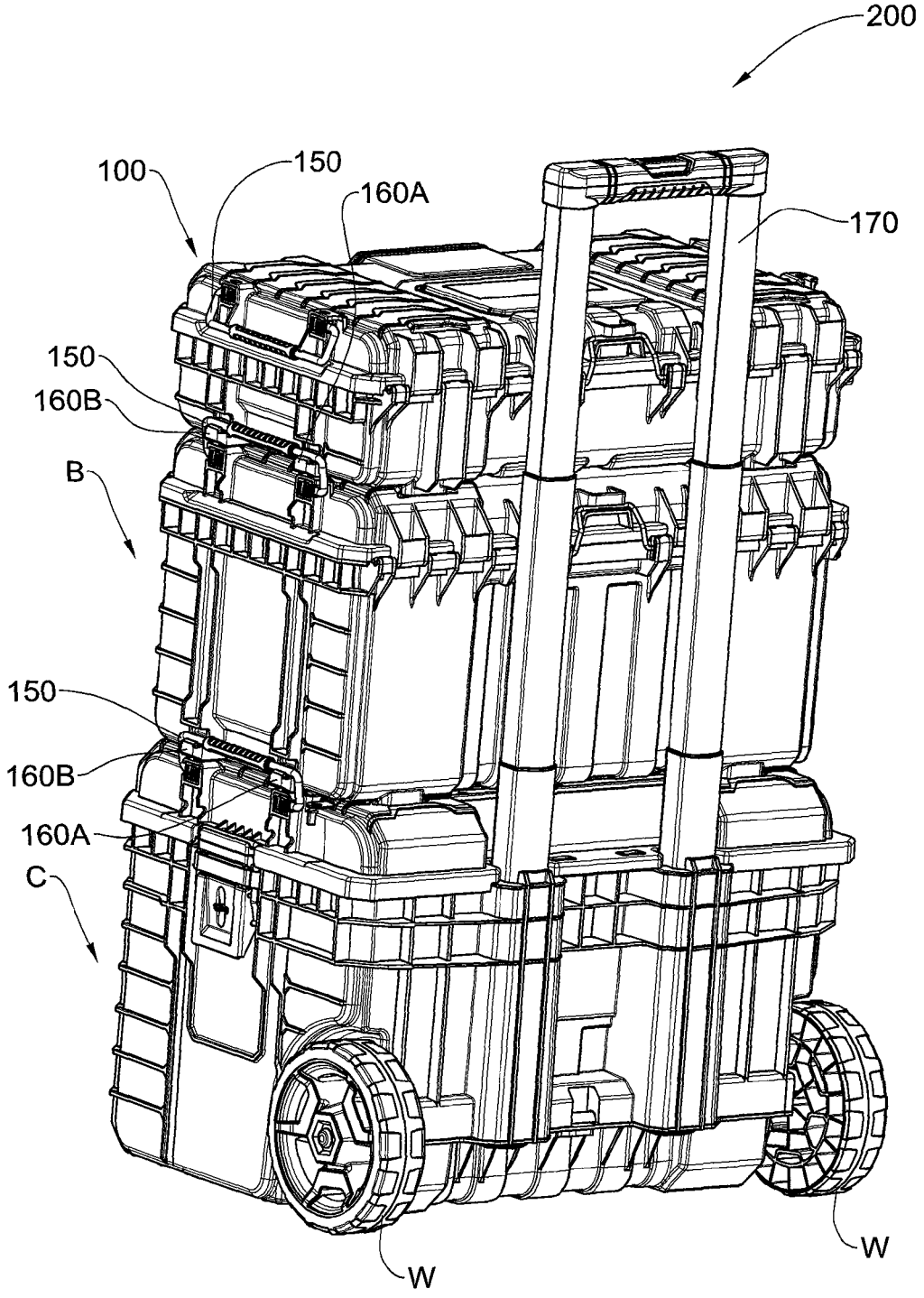
FIG. 3 is a perspective back view of a container system of three different container assemblies stacked in accordance with an example of the disclosed subject matter.

Attention is now directed to FIGS. 2A to 3 which illustrate two like container assemblies 100 in accordance with the presently disclosed subject matter stacked one over the other. FIG. 2A illustrates the two container assemblies stacked with the latch members 150 in a disengaged configuration (i.e. non-engaged position) such that the two latch members 150 fully shown in this example are in a first, resting position I (i.e. the first, resting non-engaged position) in which the latch member 150 is substantially parallel to the sides of the container assembly 100. FIG. 2B illustrates the same two container assemblies stacked showing the other side of the assembly in which the latch members are in a second position II. The latch member of the top container 100 is pivoted/lifted upwards, freely extending above the top surface 122 of the cover 120. In this configuration II the latch member can constitute a side or a lifting handle for the container. The latch member 150 of the bottom container assembly 100 is also in a second position, however it is locked over the retaining member 160 such that the two container assemblies are locked and connected to each other. Thus, by lifting the top container assembly the bottom container will be moved therewith as one interlocked system of two container assemblies. It will be appreciated that the latch members 150 on both sides should be engaged with the respective retaining members 160 to prevent unintentional disengagement or relative movement of the two containers.

FIG. 3 illustrates a system 200 of three container assemblies, C, B and 100 all interlocked using a latch member 150 provided on the covers locked over the respective retaining members 160 provided at the lower portion 142 of the side wall of the respective container assembly 100 stacked thereover. This facilitates transportation of the system in unison. In this example the system is further provided with two side wheels W and a central upwardly extending carrying handle 170 extending upwards from rear wall of the bottom container and protruding above the top container assembly to allow e.g. tilting and wheeling the system.

Figure 4:
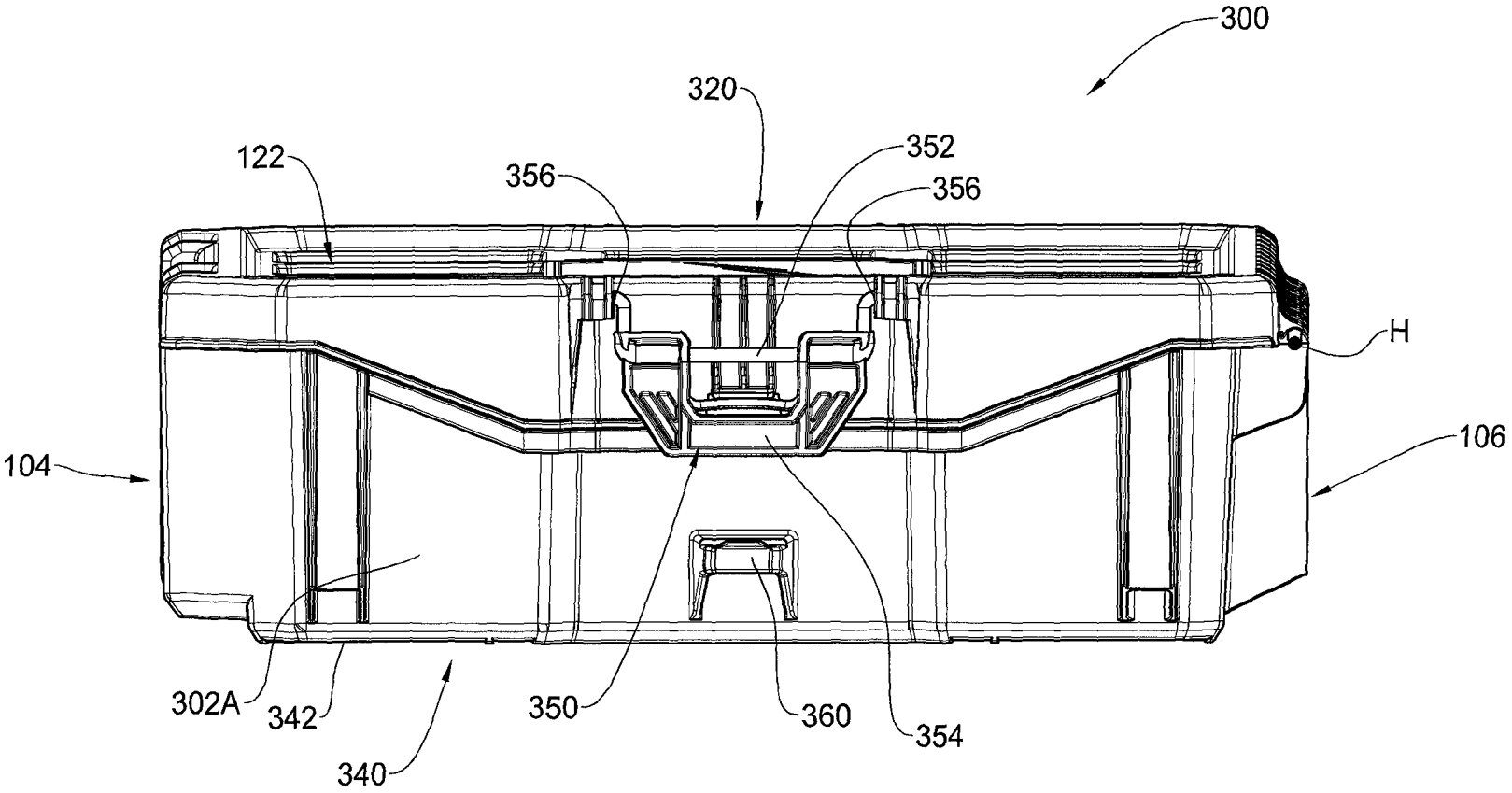
FIG. 4 is a side view of a container assembly in accordance with another example of the disclosed subject matter.
Figure 5A:
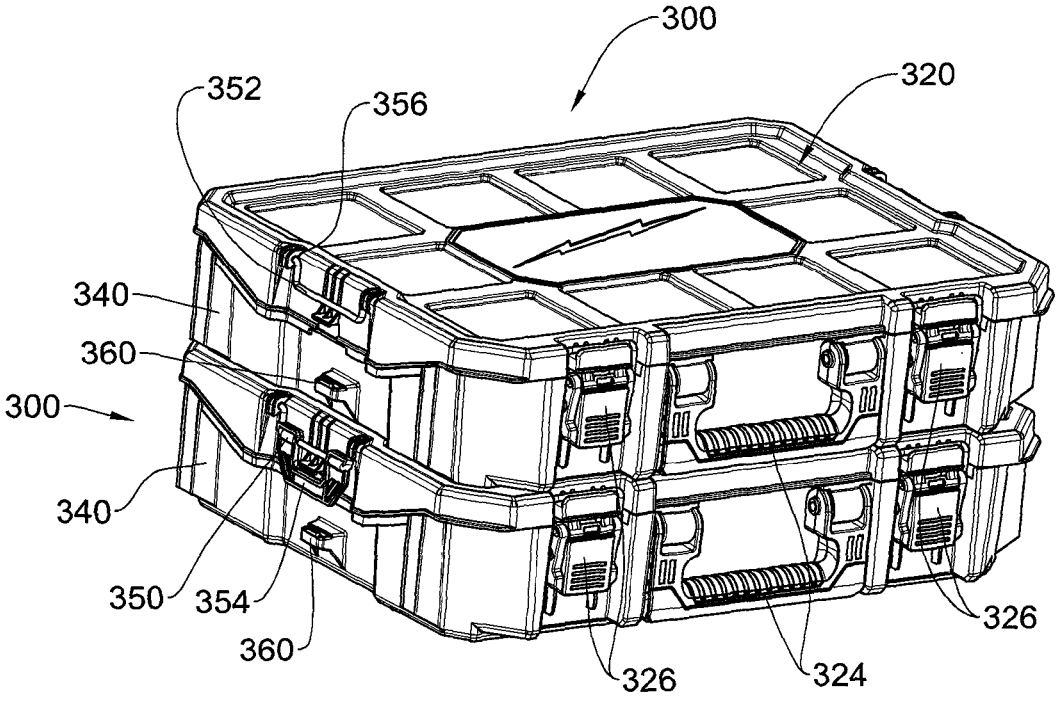
FIG. 5A and FIG. 5B are a perspective view of two like container assemblies of FIG. 4, stacked one atop the other.
Figure 5B:
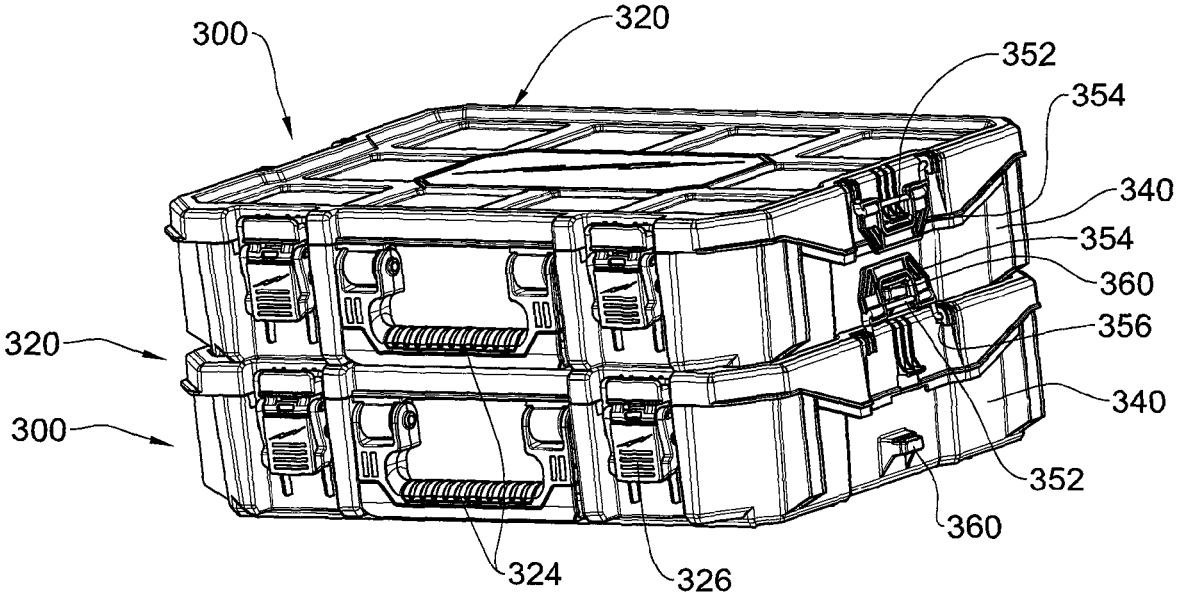

The example illustrated with reference to FIGS. 4 to 5B provides for a container assembly 300 which in this example is an organizer system. Elements having similar function to those of the assembly 100 described with reference to FIGS. 1A to 2B, are marked using similar reference numerals upped by 200. One difference between the container assembly 100 and container assembly 300 resides in the structure of the latch member 350 and the retaining member 360. In this example, there is provided a single retaining member 360 provided at the bottom portion of the side wall of the container 340. The latch member 350 is provided parallel thereto on the side flap of cover 320, covering the container 340. As seen in FIG. 5B, when two like container assemblies 300 are stacked one on top of the other, to lock the two assemblies, the latch member 350 of the container assembly at the bottom is pivoted to the second position and snapped to engage the retaining member 360 of the container provided on the top. As in the previous example, this locking engagement allows securing the two assemblies together and facilitates secure storage and transport of the resultant system of two assemblies.

It will be appreciated that any number of container assemblies 100, 300, can be stacked one over the other and locked in accordance with the disclosed subject matter.

Figure 6A:
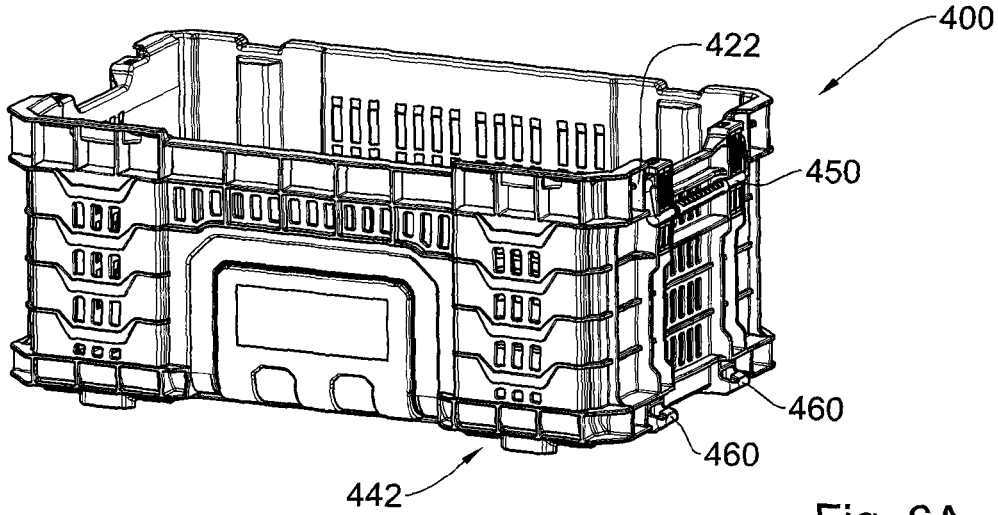
FIGS. 6A to 6C illustrate a container assembly in a perspective view where the container is illustrated with the handles in a resting position (6A), a working position (6B) and a front view of the same container (6C) in accordance with yet an example of the disclosed subject matter.
Figure 6B:
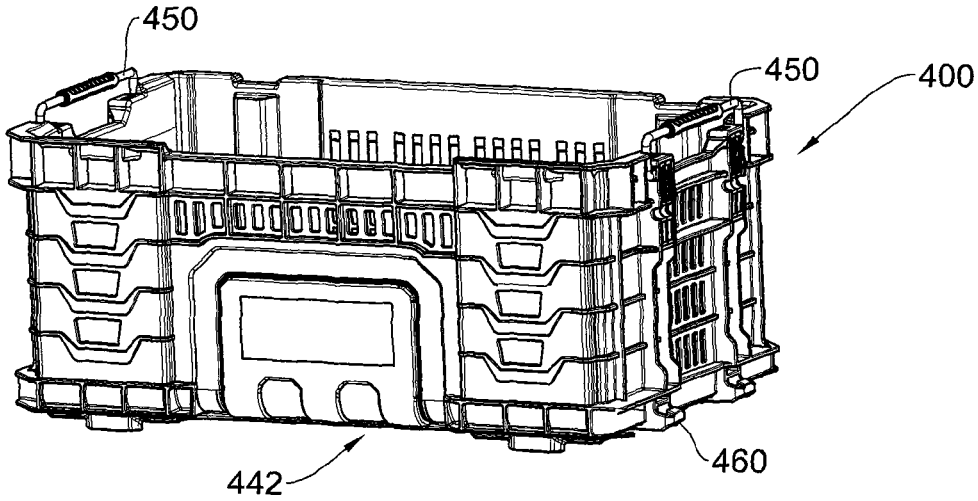
Figure 6C:
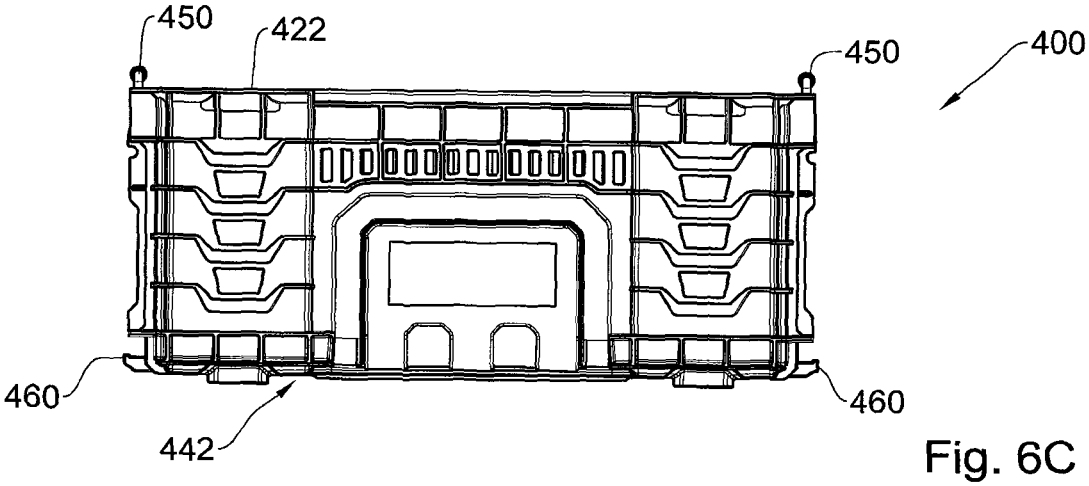
Figure 7C:
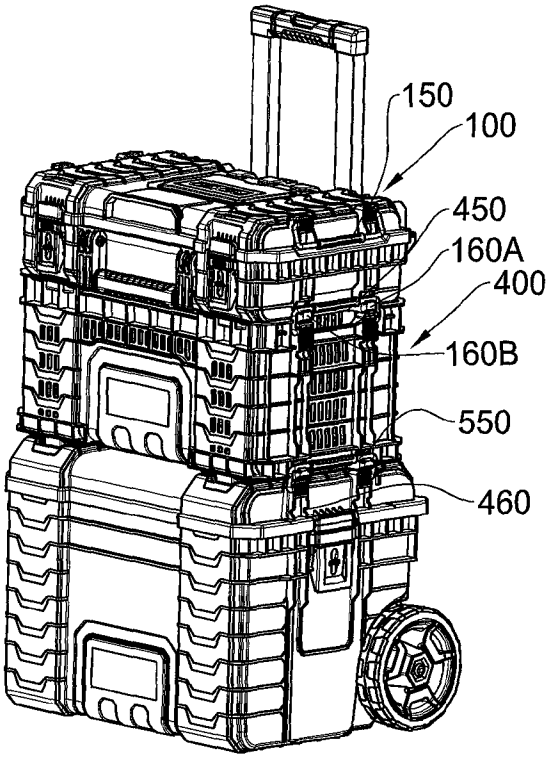
FIG. 7A to 7C illustrate in a perspective view the container assemblies in accordance with the examples of the disclosed subject matter, in a stacked configuration in various combinations.
Figure 7B:
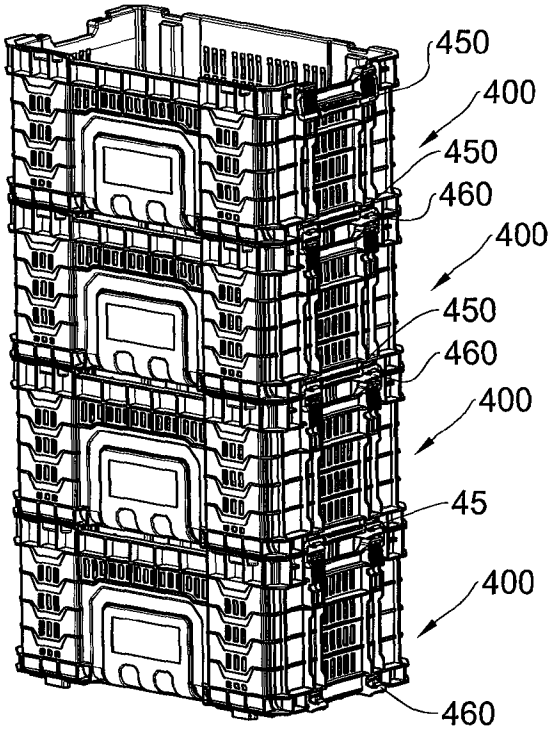
Figure 7A:
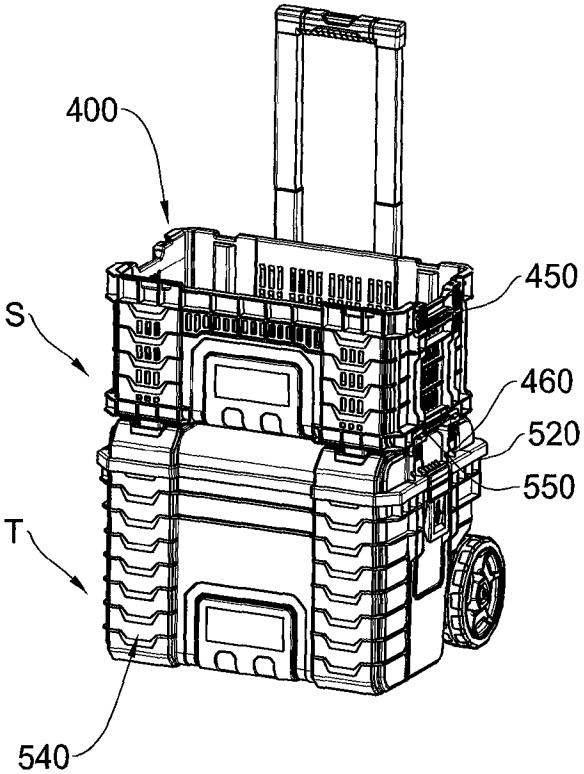

FIGS. 6A to 6C are another example of the container 400 in accordance with the disclosed subject matter. The difference between the container 400 and the previous example is lack of cover. In this example the container is a crate having a latch member 450 provided at the top portion of the respective side wall and a retaining member 460 (in this example two retaining members for each latch, as discussed also with reference to the example of FIG. 1A) provided at the bottom portion of each side wall, in parallel and coextending with the respective latch member. As seen in FIGS. 7A to 7B, the crate 400 can be stacked with like crates and interlocked therewith in accordance with the present invention (e.g. FIG. 7B) or provided as part of a system of different container systems, which are also provided with a respective latch members and retaining members as illustrated in FIGS. 7A and 7B.

Figure 8A:
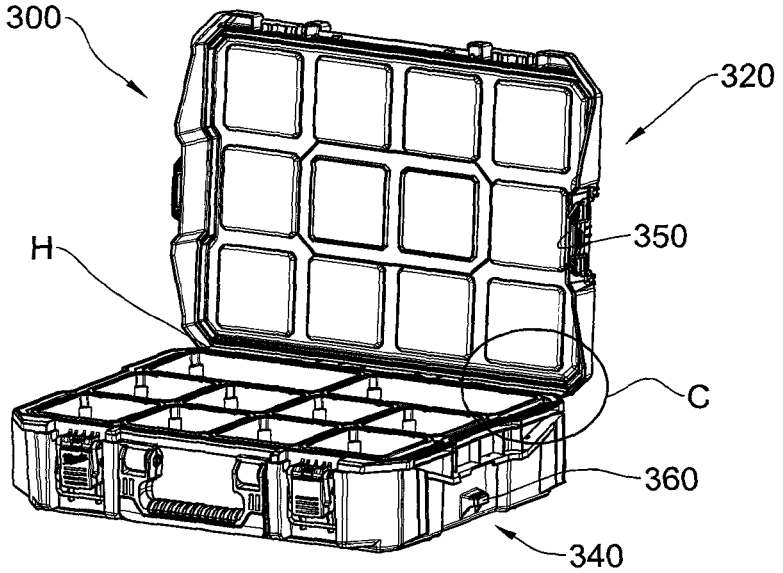
FIG. 8A to 8C illustrate a container assembly of FIG. 4, with a cover in varying positions respective the container interior.
Figure 8B:
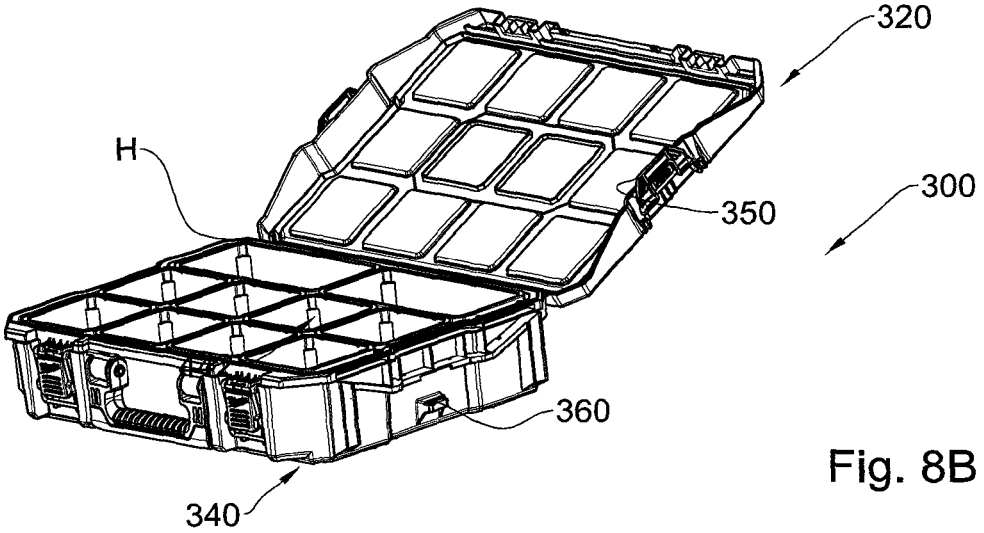
Figure 8C:
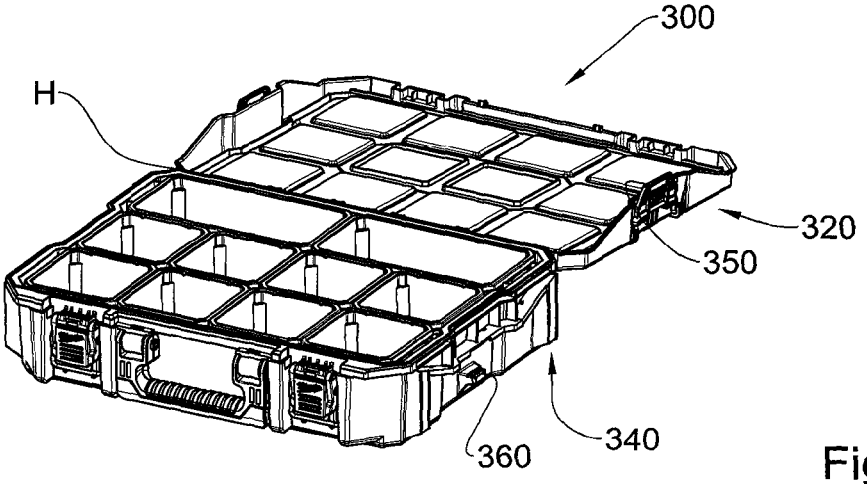
Figure 9B:
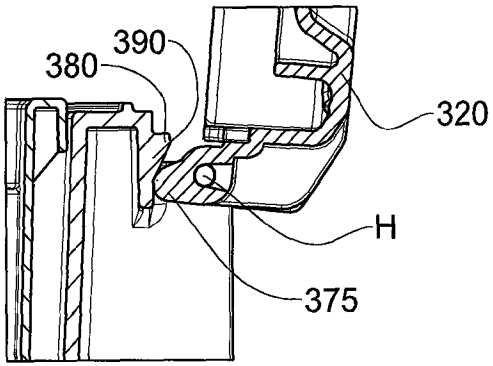
FIGS. 9A to 9D illustrate portion marked C in FIG. 8A, showing the cover in different positions respective the container, in accordance with an example of the disclosed subject matter.
Figure 9D:
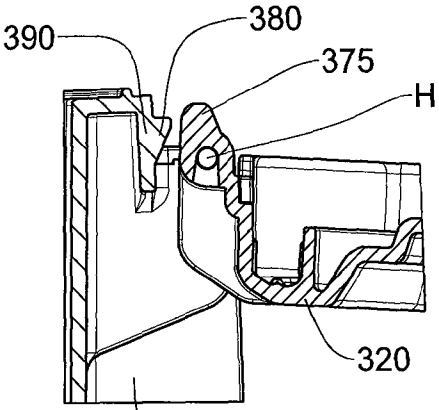
Figure 9A:
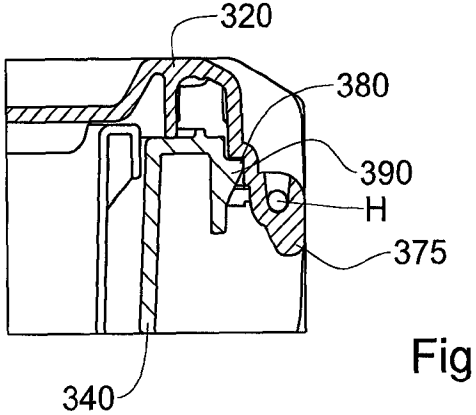
Figure 9C:
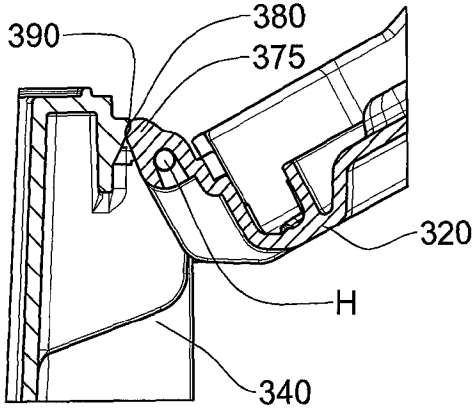

FIGS. 8A to 9D illustrate the container assembly 300 discussed above. The container assembly comprises a container 340 and cover lid 320 hingedly articulated thereto. The lid 320 is configured to extend between a closed position as seen e.g. in FIG. 4, a fully open position seen in FIG. 8C where the lid 320 is open at about 180° with respect to the container 340. As seen in FIGS. 8A and 8B the lid is configured to extend at intermediate positions between the closed and fully open positions and in the illustrated examples extends normal to the container (FIG. 8A) and at about 140° (FIG. 8B). These intermediate positions are facilitated by a friction system constituted by an arresting member 380 provided at the top end of the container 340 at the location of the hinge H and a respective friction element 375, in this example a protrusion of the respective edge of the cover 320. As seen in the enlarged portion C (FIG. 8A) illustrated in FIGS. 9A to 9C, in the fully closed (FIG. 9A) and a fully open (FIG. 9D) positions the friction system is at rest, namely the friction element 375 and the arresting member 380 are not engaged and at the intermediate positions, the friction element 375 engages the arresting member at various levels of friction force. The arresting element 380 is an outward protrusion, having a shoulder like structure with an undercut 390, such that at the engaged configuration, the friction element 375 glides over and exerts force over the undercut portion 390.

It is appreciated that any one of the containers can be of different type as far as its design, size, purpose and configuration, however each configured for detachably attachable to one another by a locking mechanism as will be discussed herein with greater detail. For example, the containers can be storage units, organizers, a folding chair, a folding work bench, a utility item, e.g. a power generator, etc.

Figure 10A:
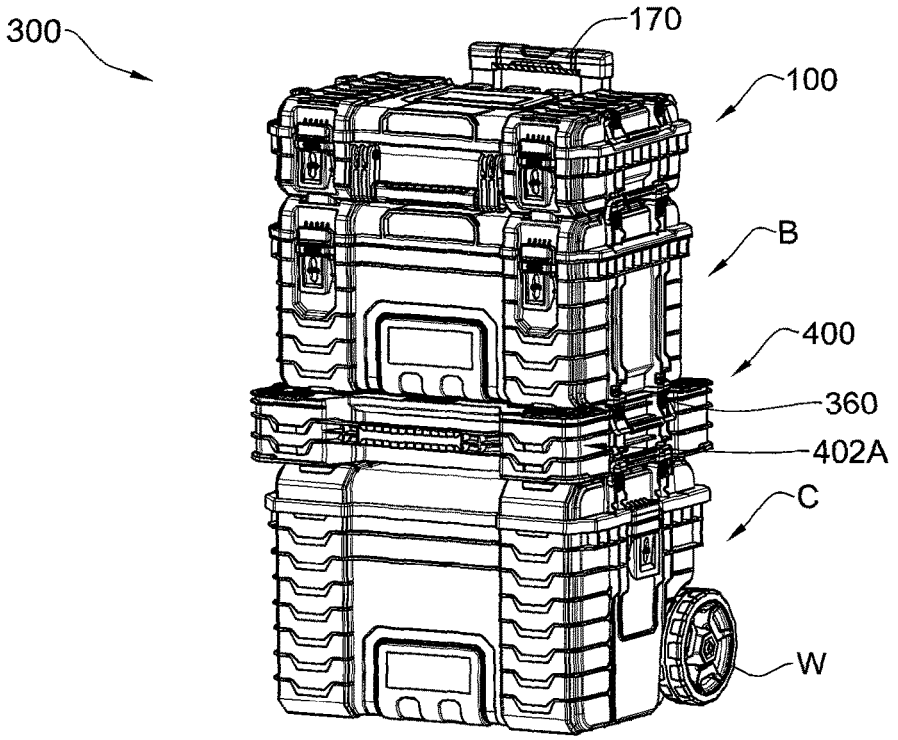
FIGS. 10A to 10C illustrate a container assembly comprising a work bench, the work bench illustrated at its various working positions in FIG. 10C, in accordance with the disclosed subject matter.
Figure 10B:
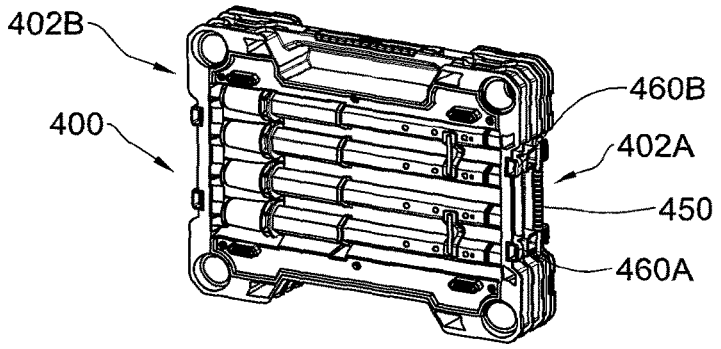
Figure 10C:
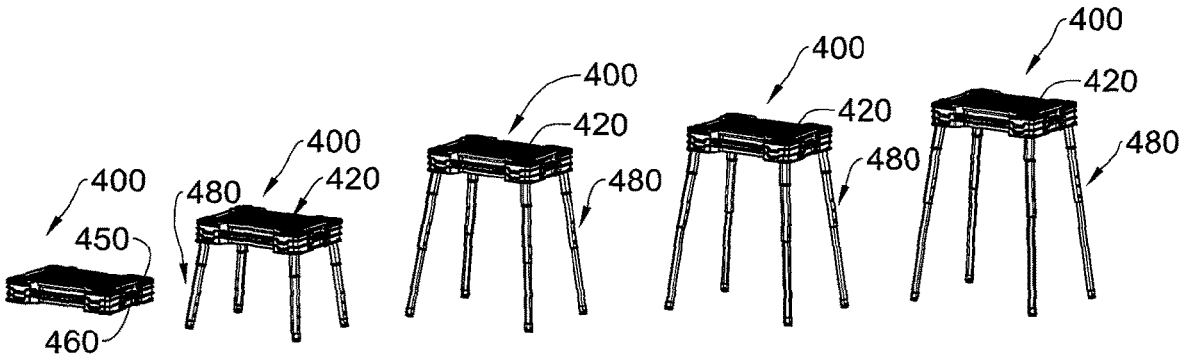

FIG. 10A illustrates an assembly 300 similar to the assembly 200 of FIG. 3, differing in that one of the containers in the assembly is a work bench 400. This work bench, as best seen in FIGS. 10B and 10C, is configured with a work unit 420 having a width providing for a side wall and four extendable legs 480, which can be maintained in their folded configuration (as seen in FIG. 10B), within the space defined by the sidewalls of the workbench 400. The two opposite side walls (only 402A clearly seen in the illustrations), each comprise an arresting member 460A and 460B and a latch member 450. To lock the work bench to the other assemblies C and B, the latch member 450 of the workbench 400 at the bottom is pivoted to the second position and snapped to engage the retaining member 360 of the container provided on the top. As in the previous example, this locking engagement allows securing the two assemblies together and facilitates secure storage and transport of the resultant system of two assemblies.

It will be appreciated that any other container can be stacked in the assembly provided the locking arrangement thereof is aligned with the locking arrangement of at least one other container/assembly in the system. The term container as used herein denotes any type of container, or work unit, which can be used as a tool caddy, organizer, traveler bag, cosmetics bag, storage containers, locomoting containers, etc. the term container includes also units used in conjunction with a tool caddy, such as a work bench, etc.

The invention claimed is:

1. A container assembly comprising a container for storage and transport of goods comprising at least one side wall and a bottom wall defining together an interior space and a cover for closing the opening, having a top surface, wherein the cover comprises at least one latch member movable between at least a first, resting non-engaged position and a second, engaged position, wherein the container comprises a retaining member on the at least one side wall and positioned parallel to the latch member such that the latch member is configured for engaging with a retaining member of another container when in the second position to connect the container to the at least one other container, wherein when the at least one latch member is at the first, resting non-engaged position, the at least one latch member is flush with the side wall of the cover, and further wherein when at the second, engaged position, the cover of the container can be disposed into an open position.

2. The container assembly of claim 1, further comprising at least one first container and at least one second container, detachably attachable to one another by a locking mechanism, the locking mechanism interacts between the at least one first container and at least one second container wherein the at least one first container is configured at a top portion thereof with a pivotable latch member, and the at least one second container is configured at a corresponding bottom portion thereof with a retaining portion, wherein said latch member is pivotable between a locked position at which it engages said retaining portion, and an unlocked position at which it is pivotally displaced into disengagement from said retaining portion.

3. The container assembly of claim 1, wherein the at least one latch member can constitute a handle for the container assembly.

4. The container assembly of claim 1, wherein the cover is pivotally connected to a rear side of the container portion.

5. The container assembly of claim 1, further comprising a carrying handle located on the container portion or the cover portion.

6. The container assembly of claim 1, wherein the latch member is pivotably connected through at least one hinge.

7. The container assembly of claim 1, wherein the interior space of the container is divided into a plurality of compartments.

8. The container assembly of claim 1, wherein the latch member and the engaging member are constructed and arranged to be spaced apart such that they are positioned to be vertically aligned with respect to one another.

9. The container assembly of claim 1, wherein the retaining member is an outwardly protruding hook like member configured and shaped to hold and\or catch and prevent movement of the latch member when locked thereon.

10. The container assembly of claim 1, wherein the latch member is configured to pivot in a clockwise and a counterclockwise manner.

11. The container assembly of claim 1, further comprising a container and a hinged lid member configured to cover the container, wherein the hinge area further comprises at least one arresting member and a friction member such that the lid has a closed and an open configurations wherein the arresting member and the friction element are disengaged and intermediate positions configured between the open and closed configurations wherein the friction element engages the arresting member.

* * * * *